United States Patent [19]

Landa et al.

[11] Patent Number: 4,977,846

[45] Date of Patent: Dec. 18, 1990

[54] BOAT MOORING DEVICE

[76] Inventors: Joseph Landa, 7700 Creekbend #35, Houston, Tex. 77071; Michael Landa, 9650 Meadowglen La., Houston, Tex. 77063

[21] Appl. No.: 449,981

[22] Filed: Dec. 13, 1989

[51] Int. Cl.[5] ..... B63B 21/00

[52] U.S. Cl. ..... 114/230

[58] Field of Search ..... 114/230, 219, 221 R

[56] References Cited

U.S. PATENT DOCUMENTS

| | | | |
|---|---|---|---|
| 3,224,404 | 12/1965 | De Jong | 114/230 |
| 3,406,651 | 10/1968 | Jalbert | 114/230 |
| 4,686,926 | 8/1987 | Vance | 114/230 |
| 4,708,083 | 11/1987 | Billings | 114/221 R |

*Primary Examiner*—Sherman Basinger

[57] ABSTRACT

A system for mooring boats to docks, consisting of two identical mooring devices, which will accommodate the wide variety of boat hull and dock designs and will prevent damage to boat hulls and docks by maintaining a distance between boats and docks while moored. The mooring device comprises a mounting bracket which may be attached to a dock in various positions and provides for pivotal attachment of mooring arm to mounting bracket which allows vertical movement of mooring arm while preventing horizontal movement of mooring arm. The mooring arm comprises an inner hollow elongated member telescoping within an outer hollow elongated member. A thru bolt secures the two telescoping members at a fixed length by means of vertically aligned holes in both of the two members. An end cap with two side by side openings closes the outer end of the inner member. A single length of rope extends through the bore of the two members. One end of the rope exits through a hole in the outer member adjacent to the mounting bracket. The opposite end of the rope exits through one of the holes in the end cap and enters the other hole in the end cap, is secured within the mooring arm, forming a noose in the rope. A protective cushion is attached to the outside of the end cap.

6 Claims, 2 Drawing Sheets

BOAT MOORING DEVICE

BACKGROUND—FIELD OF INVENTION

This invention relates to a mooring device, specifically to the mooring of boats to docks, preventing contact between boats and docks by maintaining boat at various distances from dock while permitting motion due to wind, waves, currents, and changes in water level.

BACKGROUND—DESCRIPTION OF PRIOR ART

The prior art relating to devices for mooring boats is extensive. This art includes bumpers or fenders which may be attached to a boat or a dock to prevent contact of boat with dock, resulting in damage to either. The use of bumpers and fenders is not consistently reliable in that these devices can become displaced resulting in contact of boat with dock.

Other mooring devices have been developed which separate boats from docks to which boats are moored. Many of these devices employ various elongated members to separate a boat from a dock. U.S. Pat. Nos. 4,817,551, 4,697,538, 4,686,926 are examples of mooring devices with constant length.

These devices are limited in their application to accommodate the wide variety of boat hulls and dock designs. U.S. Pat. No. 4,781,138 is an example of a mooring device which employs telescoping one member within another. However, this device is limited in application to accommodate the wide variety of boat hulls and dock designs, employs guy ropes to achieve stability is cumbersome and time consuming to apply.

OBJECTS AND ADVANTAGES

Accordingly, a principle object of this invention is to provide a mooring system, consisting of two identical mooring devices which will be reliable, easy to install and remove, simple to apply, will accommodate a wide variety of boat hull and dock designs and will prevent damage to boat hull and dock by maintaining a distance between boat and dock while moored.

A further object in the preferred embodiment, the mounting bracket is attached at the front edge, under the walking surface of the dock, so that interference with the walking surface is avoided and to permit the mooring arm to swing downward, when released from boat, so that the mooring device is out of the way and is not jutting out from the dock. In an alternate application, the mounting bracket is attached to the outer surface of the dock piling, so that interference with the walking surface of the dock is avoided and to permit the mooring arm to swing downward, when released from the boat, so that the mooring device is out of the way and is not jutting out from the dock. In a further alternate application the mounting bracket is attached to the front edge, on the walking surface of the dock. Utilized in pairs to moore a boat, the versatility in attaching the mounting brackets to a dock makes possible many combinations of mooring applications.

A further object in the preferred embodiment, a thru bolt connects the mooring arm to the mounting bracket by passing through axially aligned openings in the mooring arm and through axially openings in the mounting bracket for quick installation and removal of mooring arm from mounting bracket. A hair pin cotter secures the thru bolt. The thru bolt connection prevents side to side movement of the mooring arm and alloys vertical movement of the mooring arm caused by waves, winds, currents and changes in water level while boat is moored.

Another further object in the preferred embodiment, the mooring arm consists of an inner rigid hollow elongated member telescoping within an outer rigid hollow elongated member. Pairs of adjustment holes in the inner member align with a pair of holes in the outer member for passage of a thru bolt, securing the inner member to the outer member at a specific length. A hair pin cotter secures the thru bolt in position, preventing accidental removal of thru bolt.

A further object in the preferred embodiment, a single length of rope passes through the composite bore defined by both elongated members. One end of the rope passes through an opening in the top of the outer member. An end cap on the inner member, having two side by side holes for passage of the mooring rope, closes one end of the mooring arm. The other end of the rope exits the bore of the mooring arm by passing through one of the holes in the end cap and passes through the other hole in the end cap, entering the bore of the mooring arm and is prevented from exiting the bore by a restraining means such as a knot. A loop is formed in the mooring rope that is adjustable.

Another further object in the preferred embodiment, the loop formed in the mooring rope is placed around a boat mooring cleat and tightened by pulling the tag end of the mooring rope at the opening in the outer member and then is secured to the outer member with an overhand knot. Any pulling force at the loop end of the mooring rope causes the overhand knot to become tighter.

DESCRIPTION OF INVENTION

Figure 7:
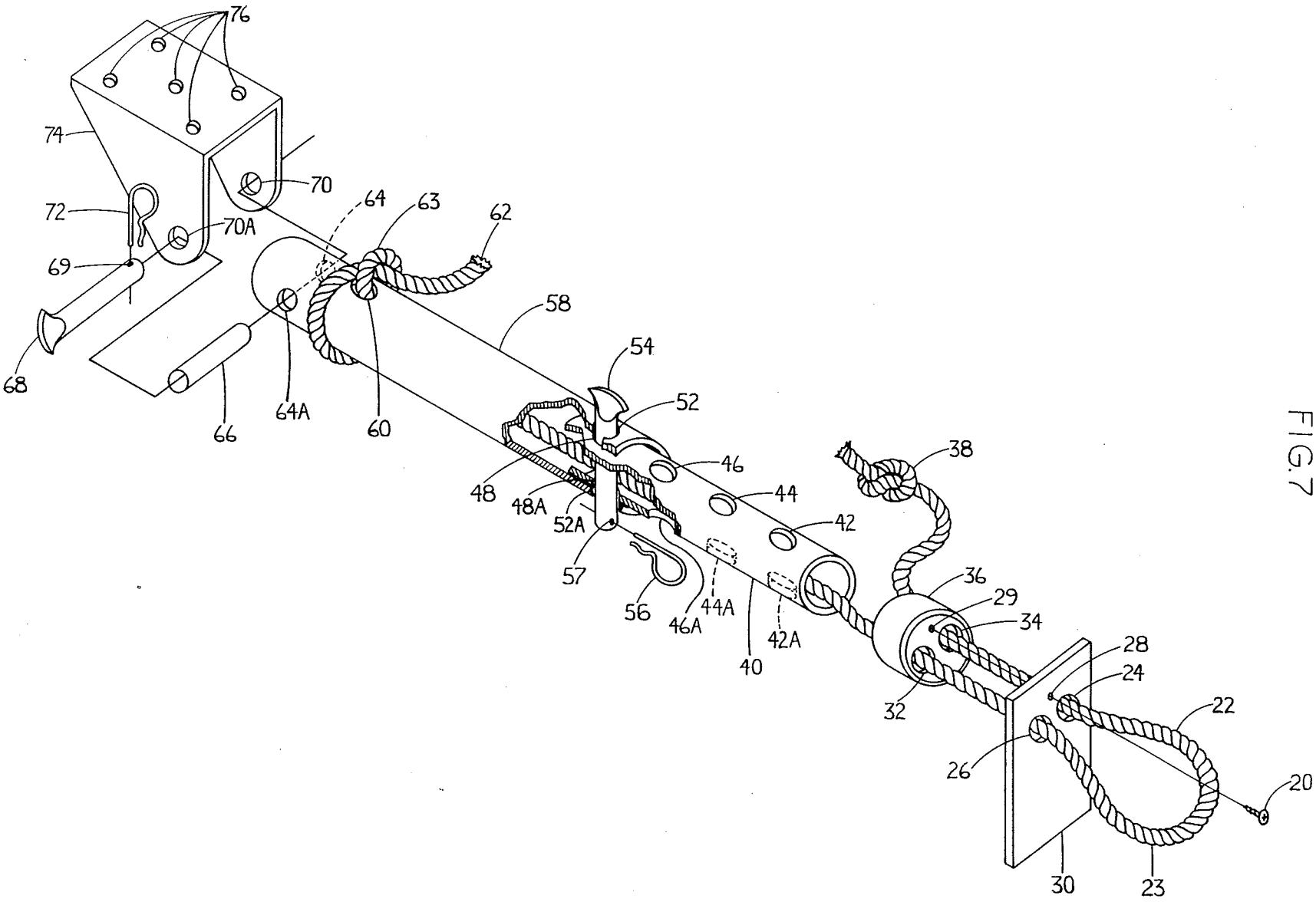
FIG. 7 illustrates an overall perspective view of a mooring device.

FIG. 7 shows an overall view of a multi-piece mooring device. The mooring device comprises: Attachment screw 20 passes through hole 28 in protective cushion 30 and hole 29 in end cap 36. Protective cushion 30 with holes 24 and 26 to provide passage of mooring rope 22, hole 28 to provide passage of attachment screw 20. End cap 36, may be fabricated from polyvinyl chloride, with holes 32 and 34 to provide passage of mooring rope 22, hole 29 to provide attachment for attachment screw 20. Mooring rope 22, has a knot 38; a tag end 62 which passes through hole 34 of end cap 36, hole 24 of protective cushion 30, hole 26 in protective cushion 30, hole 32 in end cap 36, through inner hollow elongated member 40, through outer hollow elongated member 58, through hole 60 in outer member 58. Knot 38 of mooring rope 22 prevents passage of mooring rope 22 through hole 34 in end cap 36. Inner member 40 may be fabricated from polyvinyl chloride, with holes 42, 42A, 44, 44A, 46, 46A, 48, 48A to provide passage of thru bolt 54. Thru bolt 54, preferably made of stainless steel, passes through hole 52 in outer member 58, hole 48 in inner member 40, hole 48A in inner member 40 and through hole 52A in outer member 58. Hair pin cotter 56 passes through hole 57 in thru bolt 54. Outer member 58, may be fabricated from polyvinyl chloride, with holes 52, 52A for passage of thru bolt 54, hole 60 for passage of tag end 62 of mooring rope 22, holes 64, 64A for passage of bushing 66. Bushing 66 passes through holes 64A and 64 in outer member 58. Mounting bracket 74 with holes 76 for passage of appropriate screws to attach mounting bracket 74 to a dock, vertical spaced-apart side members with each side member having one of holes 70A or 70, axially aligned with one another for passage of thru bolt 68.

Thru bolt 68, preferably made of stainless steel, passes through hole 70A of mounting bracket 74, bushing 66 and through hole 70 of mounting bracket 74. Hair pin cotter 72 passes through hole 69 of thru bolt 68.

OPERATION OF INVENTION

Figure 1:
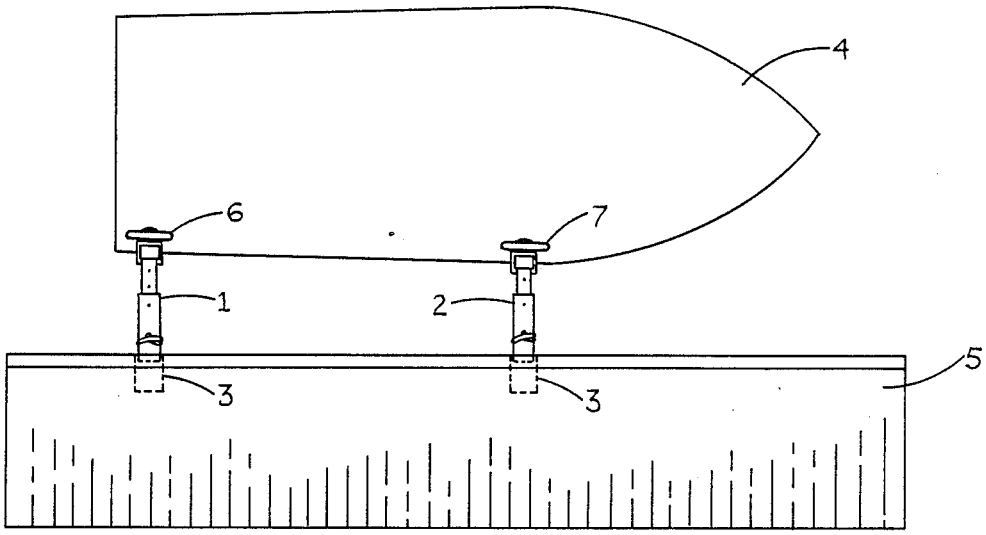
FIG. 1 illustrates a manner to use the invention to secure a boat to a dock.

FIG. 1 of the drawings show a typical application of a pair mooring devices, identical in construction. Mooring arms 1 and 2 are secured to boat mooring cleats 6 and 7 on boat 4. Mooring arms 1 and 2 are pivotally attached to mounting brackets 3. Mounting brackets 3 are attached to the underside surface of dock 5.

Each mooring arm 1 and 2 are adjustable in length to provide a distance between boat 4 and dock 5, preventing contact and avoiding damage to boat hull 4 and dock 5.

Figure 2:
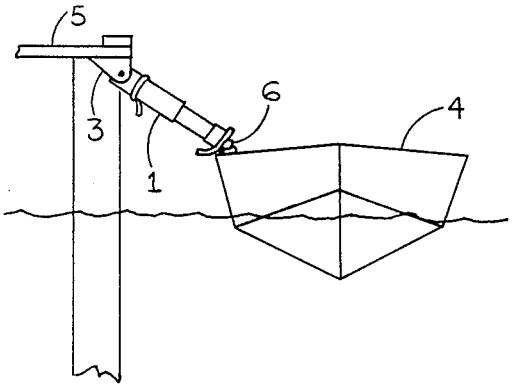
FIG. 2 illustrates a side view of a mooring device in use at a certain water level.
Figure 3:
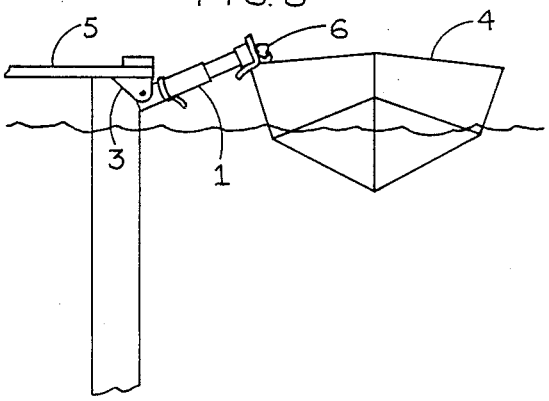
FIG. 3 illustrates a side view of a mooring device in use at a different water level in relation to FIG. 1.

FIGS. 2–3 of the drawings show a typical application of a mooring device; mooring arm 1 is secured to boat mooring cleat 6, is pivotally attached to mounting bracket 3, allowing for axial movement of mooring arm 1, transverse to mounting bracket 3, which compensates for changes in water level and maintains boat 4 at a distance from dock 5.

Figure 4:
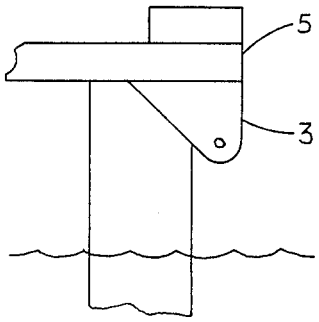
FIG. 4 illustrates a side view of the mounting bracket of the invention attached to a dock in one position.
Figure 5:
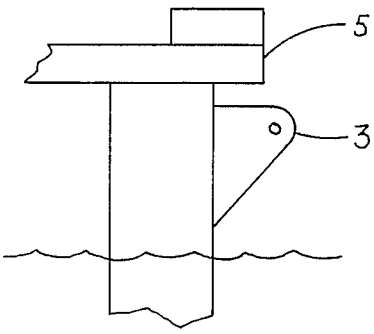
FIG. 5 illustrates a side view of the mounting bracket of the invention attached to a dock in a different position in relation to FIG. 4.
Figure 6:
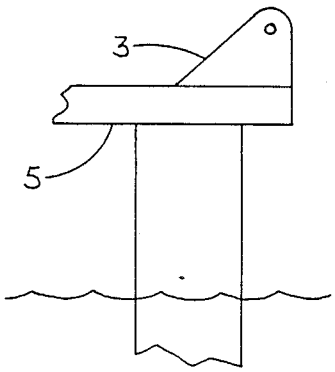
FIG. 6 illustrates a side view of the mounting bracket of the invention attached to a dock in a different position in relation to FIG. 5.

FIGS. 4–6 of the drawings show mounting bracket 3 attached to dock 5 in various positions; versatility of attaching mounting bracket 3 to dock 5 provides for application to a wide variety of dock designs.

FIG. 7 of the drawings show a multi-piece mooring device; attachment screw 20 attaches protective cushion 30 to end cap 36 by passing through hole 28 in protective cushion 30 and is secured in hole 29 of end cap 36.

Protective cushion 30 provides a cushion between end cap 36, boat hull and boat mooring cleat. Tag end 62 of mooring rope 22 passes through hole 34 in end cap 36, hole 24 in protective cushion 30, hole 26 in protective cushion 30, hole 32 in end cap 36, inner member 40, outer member 58 and hole 60 in outer member 58. Tag end 62 of mooring rope 22 is pulled taught until knot 38 in mooring rope 22 is stopped by hole 34 in end cap 36. End cap 36 is attached to inner member 40 with holes 32 and 34 of end cap 36 being horizontally aligned in relation to holes 42 and 42A of inner member 40. Inner member 40 telescopes within outer member 58. Inner member 40 with holes 42 and 42A, 44 and 44A, 46 and 46A, 48 and 48A are vertically aligned with holes 52 and 52A in outer member 58 for passage of thru bolt 54. Thru bolt 54 secures inner member 40 to outer member 58. Hair pin cotter 56 passes through hole 57 of thru bolt 54, preventing accidental removal of thru bolt 54. Bushing 66 is inserted through hole 64 and 64A in outer member 58, mounting bracket 74 with holes 76 for passage of appropriate screws is attached to a dock in any of the positions shown in FIGS. 4–6 Bushing 66 is axially aligned with holes 70 and 70A in mounting bracket 74. Thru bolt 68 passes through hole 70A of mounting bracket 74, bushing 66 and hole 70 in mounting bracket 74. Thru bolt 68 secures outer member 58 to mounting bracket 74. Hair pin cotter 72 passes through hole 69 of thru bolt 68, preventing accidental removal of thru bolt 68.

Loop 23 in mooring rope 22 is placed around boat mooring cleat and tightened by pulling tag end 62 of mooring rope 22 so that boat mooring cleat is in firm contact with protective cushion 30. Tag end 62 of mooring rope 22 is wrapped around outer member 58 and overhand knot 63 is made in mooring rope 22, securing mooring rope 22 to outer member 58.

Any pulling force applied to loop 23 of mooring rope 22 will cause overhand knot 63 of mooring rope 22 to become tighter.

When the device is attached to the boat 4 and to the dock 5 as illustrated in FIGS. 2 and 3 of the drawings, it can be observed that the various motions imparted to boat 4 as a result of movement of the water will be taken up by the pivotal attachment of the mooring arm 1 to the mounting bracket 3.

Thus the reader will see the mooring system, consisting of two identical mooring devices, will be reliable, easy to install and remove, simple to use, will accommodate a wide variety of boat hull and dock designs and will prevent damage to boat hull and dock by maintaining a distance between boat and dock under most mooring conditions.

While the above descriptions contain many specificities, these should not be construed as limitations on the scope of the invention, but rather as an exemplification of one preferred embodiment thereof. Many other variations are possible for example, skilled persons will readily be able to change the dimensions and shapes of the various embodiments. They will be able to make the mooring device of alternative materials, such as other plastics and metals. Accordingly, the reader is requested to determine the scope of the invention not by the embodiments illustrated but by the appended claims and their legal equivalents.

What is claimed is:

1. A device for mooring a boat to a dock, comprising; a mounting bracket comprising a flat base and spaced-apart side members attached to said base; means for attaching said bracket base to a dock; each of said bracket side members having an opening axially aligned with one another; an adjustable mooring arm comprising an inner rigid hollow elongated member having a bore and first and second ends telescoping within an outer rigid hollow elongated member having a bore and second ends; said outer member having two axially aligned openings in said first end; pivot means pivotally securing said first end of said outer member between said bracket side members for angular displacement relative thereto about a generally horizontal axis extending transversely of said outer member; two vertically aligned openings in said second end of said outer member; a plurality of vertically aligned pairs of openings, spaced-apart, located on a line between said first end and said second end of said inner member; adjustable means securing said inner member to said second end of said outer member at various lengths between the minimum and maximum lengths defined by the said plurality of vertically aligned pairs of openings in said inner member; an opening in said outer member adjacent to said first end of said outer member; a rope having first and second ends extending through the bore of said inner and outer members; said first end of said rope extending through said opening in said outer member; said second end of said rope extending through said second end of said inner member.

2. The device of claim 1 wherein said second end of said rope is secured within the bore of said inner member; movement restraint means preventing removal of said second end of said rope from the bore of said inner member.

3. The invention of claim 2 with a noise in said rope located outside the bore of said second end of said inner member.

4. A device for mooring a boat to a dock, comprising; a mounting bracket comprising a flat base and spaced-apart side members attached to said base; means for attaching said bracket base to a dock; each of said bracket side members having an opening axially aligned with one another; an adjustable mooring arm comprising an inner rigid hollow elongated member having a bore and first and second ends telescoping within an outer rigid hollow elongated member having a bore and first and second ends; said outer member having two axially aligned openings in said first end; pilot means pivotally securing said first end of said outer member between said bracket side members for angular displacement relative thereto about a generally horizontal axis extending transversely of said outer member; two vertically aligned openings in said second end of said outer member; a plurality of vertically aligned pairs of openings, spaced-apart, located on a line between said first end and said second end of said inner member; adjustable means securing said inner member to said second end of said outer member at various lengths between the minimum and maximum lengths defined by the said plurality of vertically aligned pairs of openings in said inner member an opening in said outer member adjacent to said first end of said outer member; an end cap, having first and second side by side openings, closing said second end of said inner member; a rope having first and second ends extending through the bore of said inner and outer members; said first end of said rope extending through said opening in said outer member; said second end of said rope extending through said first opening of said end cap and said second opening of said end cap; movement restraint means preventing removal of said second end of said rope from the bore of said inner member.

5. The device of claim 4 with a protective cushion attached to said end cap.

6. The device of claim 4 with a noose in said rope located outside of said end cap.

* * * * *